United States Patent [19]

Corsello

[11] Patent Number: 4,553,728

[45] Date of Patent: Nov. 19, 1985

[54] MULTIPLE POSITION BOOKSTAND

[76] Inventor: Thomas Corsello, 100 Alvord Park Rd., Torrington, Conn. 06790

[21] Appl. No.: 613,336

[22] Filed: May 23, 1984

[51] Int. Cl.[4] ..... A47B 97/04

[52] U.S. Cl. ..... 248/452; 248/444.1; 248/449

[58] Field of Search ..... 248/452, 445, 448, 449, 248/453, 297.2

[56] References Cited

U.S. PATENT DOCUMENTS

| | | | |
|---|---|---|---|
| 835,144 | 11/1906 | Thiele | 248/452 |
| 2,337,675 | 12/1943 | McNeil | 248/445 |
| 2,501,019 | 3/1950 | Attick | 248/453 |
| 3,370,821 | 2/1968 | Mingis | 248/452 |
| 3,889,914 | 6/1975 | Torme | 248/445 |
| 3,952,989 | 3/1976 | Bannister Hatcher | 248/452 X |
| 4,123,029 | 10/1978 | Gillotti | 248/453 |

*Primary Examiner*—Ramon S. Britts
*Assistant Examiner*—K. Chotkowski
*Attorney, Agent, or Firm*—Parmelee, Bollinger & Bramblett

[57] ABSTRACT

A multiple position bookstand is provided with a base having an angled upright support mounted thereon which permits holding an open book in an upright position on one side of the upright angled support or positioning an open book on its side edge on the back of the upright angled support to permit reading of the book in a reclining position. An upstanding base bracket is spaced behind the angled upright support to bear on the lower pages in the open book while a downwardly extending bracket movably mounted on the back of the angled upright support holds the upper pages of the open book placed on its side edge behind the angled upright support. A first movable support mounted on the back of the angled upright support which is attached to a lower movable shelf on the front of the upright support urges an open book positioned on its side edge between the base bracket and the downwardly extending bracket outward to flatten the book between these supports while the front shelf allows a book to be positioned in an upright position on the front of the shelf. The downwardly extending bracket is also positioned on an upper movable support which provides the dual function of supporting the downwardly extending bracket on the back of the upright support as well as providing an upper positioning support to position an open book in an upright position on the movable shelf. The bracket elements are all adjustable, and all support elements are movable accommodating the support in two different positions of a variety of book shapes and sizes.

4 Claims, 11 Drawing Figures

MULTIPLE POSITION BOOKSTAND

BACKGROUND OF THE INVENTION

This invention relates to a multiple position bookstand and more particularly, to such a bookstand which permits the positioning and holding an open book in an upright position as well as positioning and holding an open book on its side edge to permit reading the book in a reclining position, as well as permitting the user to turn the pages while reading in the reclining position.

Although many readers enjoy reading in bed which is relaxing, and for some is used to induce sleep, the problem resides in holding the book. In some positions the arms, hands or shoulders become tired and cramped while in others, the back may hurt, all of which inhibits the pleasure in such reading. Other bed-ridden people may be in no position to hold the book thereby requiring some sort of an elaborate pivoting table, stand or elaborate bookholding device to permit reading in an upright position. Reading from an all-out reclining position would be extremely difficult. Such elaborate stands, mounts or book holders generally are special purpose and cannot be used in multiple applications, for example, mounting the book in different positions either upright or on its side, while at the same time being adjustable enough to permit page turning in at least one of its book-holding modes.

SUMMARY OF THE INVENTION

Accordingly, it is an object of this invention to provide a new and improved multiple position bookstand which may be utilized for reading in bed without requiring any special stands or pivoting shelves which are connected to or otherwise extend over or are mounted on the bed.

Still another object of this invention is to provide a new and improved multiple position bookstand which permits positioning and holding an open book in an upright position, as well as positioning an open book on its side edge to permit reading a book in a reclining position.

Still another object of this invention is to provide a new and improved multiple position bookstand which is fully adjustable to permit the positioning and holding of different size books.

A further object of this invention is to provide a new and improved multiple position bookstand having such adjustability as to accommodate the turning of pages in a reclining position and for holding as little as a single page after it has been turned.

Still another object of this invention is to provide a new and improved multiple position bookstand which is simple to operate, fully adjustable, is mobile and permits a variety of document mounting and holding applications.

In carrying out this invention in one illustrative embodiment thereof, a multiple position bookstand is provided having a base with an angled upright support mounted thereon and extending upward therefrom. An upstanding base bracket is mounted on the base and spaced behind the angled upright support which is adapted to bear on the lower pages of an open book placed on its side edge behind the angled upright support. A downwardly extending leg movably mounted on the back of the angled upright support is adapted to hold the upper pages of an open book placed on its side behind the angled upright support. A first movable support means is movably mounted on the back of the angled upright support which is adapted to contact and urge outward an open book positioned on its side edge between the base bracket and the downward extending leg thereby flattening the open book as the first movable support means is moved upwardly and contacts the back of the book mounted therein.

A movable lower support means is movably mounted on the front of the angled upright support and has the first movable support means mounted for movement therewith. The movable lower support provides a shelf for positioning an open book on the front of the angled upright support. A movable upper support is also movably mounted on the front of the angled upright support for holding and positioning an open book on the front of the angled upright support on the shelf formed by the lower support.

Conveniently, the lower and upper support on the front of the angled upright support are movable up and down on the angled upright support which also allows the first movable support means positioned on the back of the lower support as well as the downwardly extending leg mounted on the back of the upper support to be also vertically movable up and down on said angled upright support. In addition, the downwardly extending bracket is also movable toward and away from the back of the angled upright support to permit conveniently turning and holding pages placed thereunder.

Among the many advantages of this multiple position bookstand is its mobility, adjustability, and adaptability to positioning and holding books in an either upright position or on their side edge to permit reading in a sideward reclining position.

BRIEF DESCRIPTION OF THE DRAWINGS

The invention, together with further objects, advantages, features and aspects thereof, will be more clearly understood from the following description taken in conjunction with the accompanying drawings in which like elements are designated with the same reference numerals throughout the various views.

Referring now to FIGS. 1–3, a multiple position bookstand, referred to generally with the reference numeral 10, is provided having a self-sustaining base 12 for holding the bookstand 10 in an upright position. Although not illustrated, a pad such as felt may be applied to the bottom of the base to keep it from sliding and scratching the surface where positioned. The base has a cut-out 14 in which an angled upright support 16 is mounted by any suitable means such as screws (see FIG. 9). The angled upright support 16 may also be mounted to the base in a slot cut therein in which the upright angled support 16 is glued or otherwise affixed, or may be mounted on top of the base in any suitable manner. The angled upright support 16 forms an angle of approximately 13° with the base and is preferred to be angled to support the books in a fashion which will be explained hereinafter. However, the angle is not considered to be extremely critical and will preferably range from approximately 6 to 20 degrees. The angled upright support 16 carries a central slot 18 therein, which provides a means for vertically adjusting the various supports of the bookstand 10.

Figure 3:
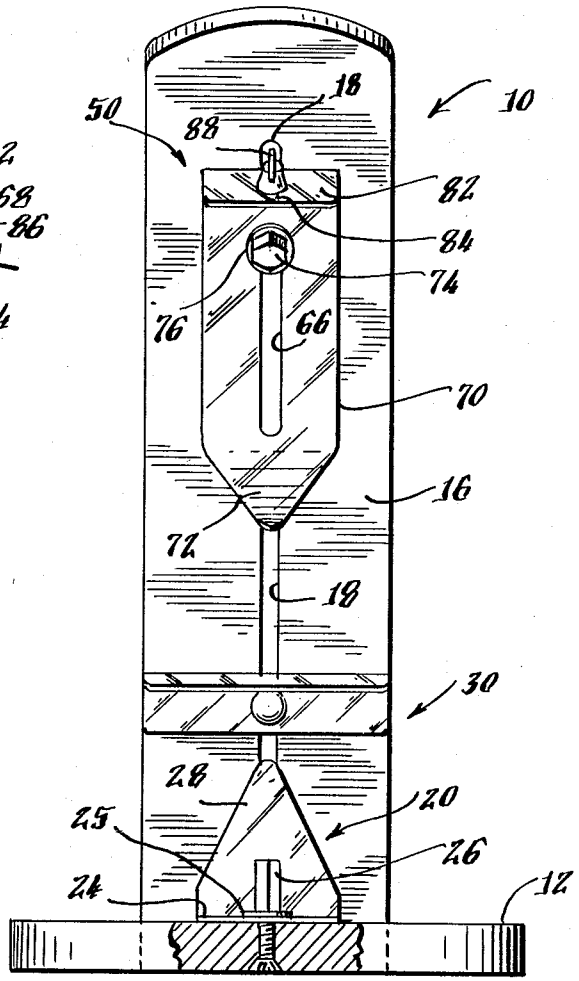
FIG. 3 is a rear view of the bookstand shown in FIG. 1.
Figure 2:
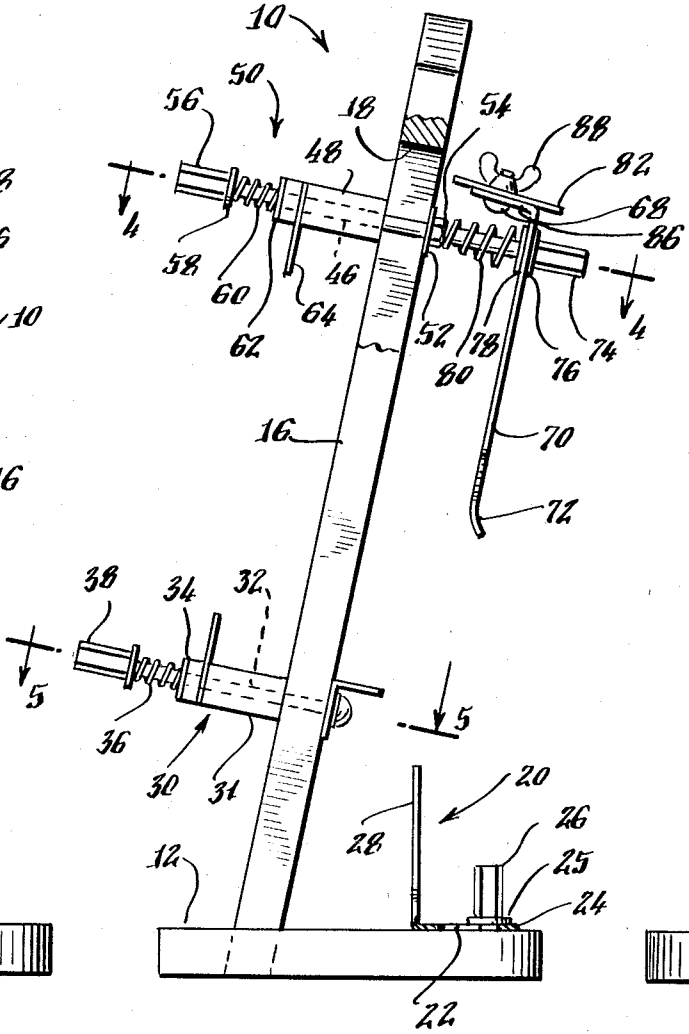
FIG. 2 is a side elevational view of the bookstand shown in FIG. 1.

As will best be seen in FIGS. 2 and 3, an upstanding base bracket 20 is movably mounted to and fro behind the angled upright support 16 by a screw 21 extending up through the base 24 and through a slot 22 in the base 24 of the base bracket 20, and is held therein by a washer 25 and a knob nut 26. When the knob nut is loosened, the upright bracket 20 having an upright tongue 28, is slidable toward and away from the back of the angled upright support 16 by the length of the slot 22. The base bracket 20 is preferably made of a transparent plastic, such as an acrylic plastic, because as will be explained hereinafter, the upstanding tongue 28 is adapted to bear on the bottom pages of a book positioned behind the angled upright support 16 on its side edge.

Figure 6:
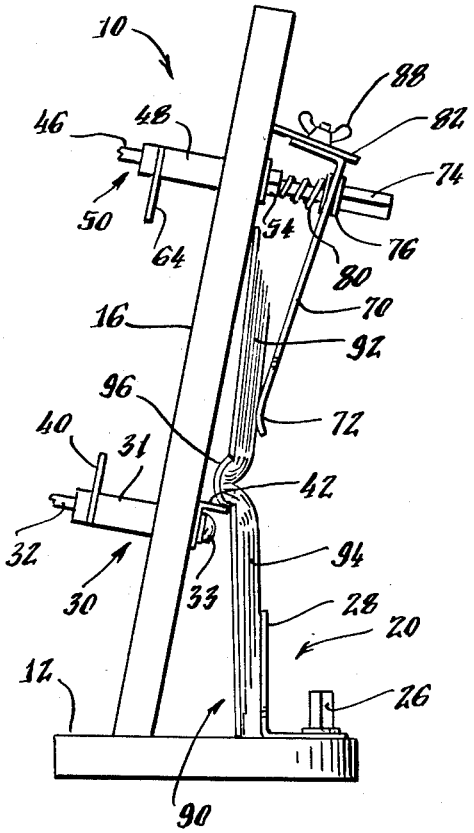
FIG. 6 is a side elevational view of an open book positioned on its side edge being positioned and held by the multiple position bookstand of the invention.

It should be pointed out that the base bracket 20 is reversible and can either be used as shown in FIGS. 2 and 6 or can be turned 90° or 180° for holding different sized books. When the base bracket 20 is reversed and 180° from the position shown in FIG. 2, the side edge of a book positioned in the stand 10 will rest on the base 24 of the bracket 20. When turned at 90° from the position shown in FIG. 2, the side edge of a book will bear on the edge of the base 24.

Figure 1:
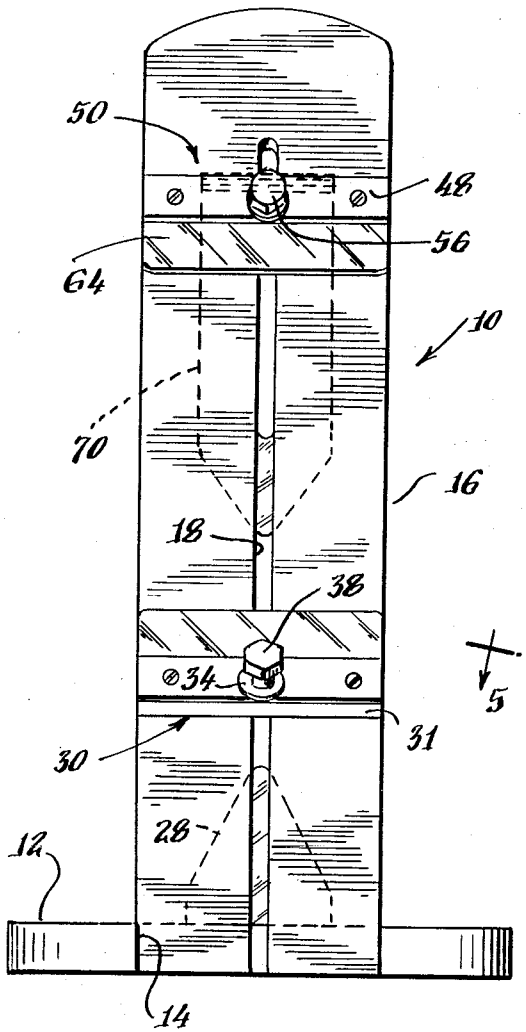
FIG. 1 is a front elevational view of the multiple position bookstand in accordance with the present invention.

As will best be seen in FIGS. 1 and 2, the angled upright support 16 carries a movable lower support assembly 30 mounted for vertical movement in the slot 18 by a stove bolt 32 which extends through the slot 18 in the angled upright support 16 and through a shelf 31 of assembly 30. The outward end of the stove bolt 32 extending out of the shelf 31 is terminated in an adjustable knob nut 38 with a washer 34 and a spring 36 interposed on the end of the stove bolt 31 between the knob nut 38 and shelf 31. The shelf 31 carries an upstanding transparent guard rail 40 which may be mounted in the shelf by screws 32. Tightening or loosening of the knob nut 38 permits the adjustable vertical movement of the shelf 31 in the slot 18 of the upright support 16.

A movable support means in the form of a right-angled bracket 42 is mounted under the head 33 of the stove bolt 32 directly to the rear of the shelf 31 of the lower support assembly 30 behind the angled upright support 16. Accordingly, when the assembly 30 is moved vertically in the slot 18 of the angled support 16, the right-angled support bracket 42 moves simultaneously therewith. The right-angled support bracket 42 provides a shelf for the book to rest on as well as performing a book-flattening function on books mounted on the backside of the angled upright support 16 as will be described more in detail hereinafter.

Figure 5:
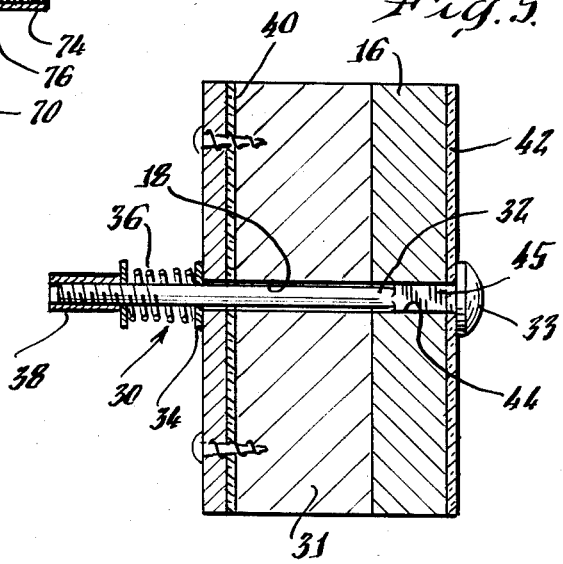
FIG. 5 is a cross-sectional view taken along line 5—5 of FIG. 2.

FIG. 5 shows a cross-sectional view of the lower support assembly 30 which has just been described. It should be noted that a square hole 44 is provided in the angled upright support 16 to accommodate the square configuration of a portion of the bolt shank 45 so that the bolt will not rotate when the knob nut 38 is screwed or unscrewed from the end of the stove bolt 32. This makes for easy adjustment of the entire lower movable support assembly 30 in the slot 18 of the angled upright support 16.

Figure 4:
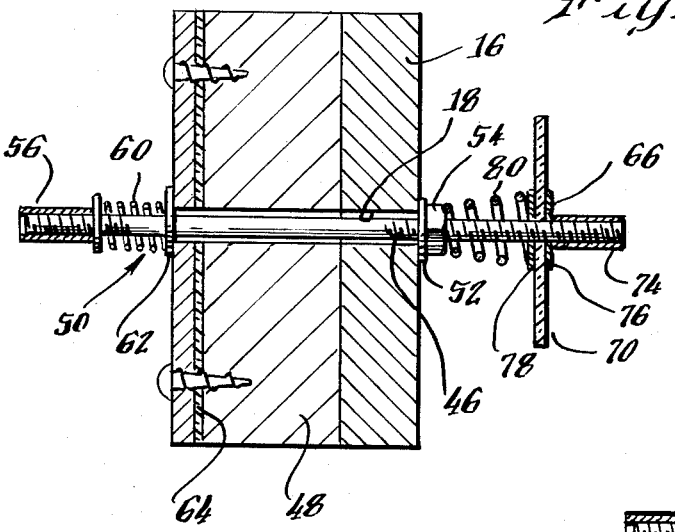
FIG. 4 is a cross-sectional view taken along line 4—4 of FIG. 2.

The upper movable support assembly referred to generally with the reference numeral 50, as will best be seen in FIG. 2 and in cross-section in FIG. 4, is mounted on a single threaded shaft 46 which extends through the upright central slot 18 in the angled upright support 16. An upper support or shelf 48 is held to the backside of the angled upright support 16 by a washer 52 and a nut 54. The nut 54 also establishes the length on both sides of the shaft 46 on which the shelf 48 and the leg 70 are supported. The shelf 48 is held on the other end by a knob nut 56 screwed on to one end of the threaded shaft 46 and bearing against a washer 58, a spring 60 and a washer 62. The shelf 48 carries a downwardly extending guard rail 64 which is preferably a transparent plastic. The upper movable support assembly 50 is adjustable vertically in the slot 18 of the angled upright support 16 simply by loosening the knob nut 56 and sliding the entire upper movable support assembly 50 in the slot to the desired position and then tightening.

The upper movable support assembly 50 also contains a downwardly extending leg 70 having an upturned foot 72 on one end thereof, and an angled base 68 on the other end thereof with the leg 70 having a central slot 66 running vertically therein. The downwardly extending leg 70 is mounted on the common threaded shaft 46 with the shaft 46 extending through the slot 66 in the leg 70 and being held thereon by a knob nut 74 bearing on a washer 76. A cone spring 80 is positioned between the nut 54 and the leg 70 bearing on a washer 78 positioned between the large end of the cone spring and the leg 70. The cone 80 keeps the leg 70 in place when not in use and to hold leg 70 with tension when in use. A plate 82 having a slot 84 therein is mounted on the base 68 of the leg 70 by a screw 86 and held thereon by a wing nut 88. The slotted plate 82 provides an adjustable means for spacing the upper end or base 68 of the leg 70 from the back of the angled upright support 16. The position of the screw 86 in the slot 84 of the plate 82 determines the angle that the leg 70 makes with the back of the angled upright support 16 which spacing requirement changes with the number of pages that are being held under the leg. Accordingly, if one page of a document or a book is to be held, the screw 86 will be moved outward and tightened, in effect forcing the leg 70 downwardly and in towards the back of the angled support 16. As more pages are stored and held under the leg 70 as a book or document is being read, the screw 82 will be moved closer to the back of the angled upright support 16 permitting the leg 70 to be positioned further away from the back of the angled upright support 16, so that it may hold more pages. The plate 82 also provides a handle for facilitating the upward or downward movement of the leg 70.

One of the applications of bookstand 10 will now be described in connection with FIGS. 6, 7 and 8. In this particular mode of operation, a book 90 is positioned in the bookstand 10 behind the angled upright support 16 with the top pages 92 thereof being held by the leg 70 while the side edge of the cover is being supported by the base 12 and the lower pages 94 being held in position by the tongue 28 of the base bracket 24. The back of the book 96 is supported by the right-angled support 42 of the lower movable support assembly 30. By loosening the knob nut 38 on the lower movable support assembly 30, and sliding the whole assembly upward in the slot 18 of the angled upright support 16, the right-angled support 42 comes in contact with the back of the book 90 eventually bearing on the back binding 96 which forces the book 90 outward providing a flattening effect. The support or shelf 42 supports and holds the book binding 96 at the back 90. Once the book 90 is supported in the proper position, the knob nut 38 is tightened to secure the lower support assembly 30 in the slot 18 of the angled upright support 16. The base bracket 20 is adjustable and may be moved toward and away from the back of the angled upright support 16, and its position will depend on the size of the book and the number of pages 94 which are to be held thereby. Since the tongue 28 of the base bracket 20 is transparent, it will not interfere with the reading of any pages being held thereby. The upper pages 92 of the book 90 are held in position by the upturned foot 72 of the adjustable leg 70. The leg 70 may be angled in more toward the angled upright support 16 by loosening the wing nut and spacing the leg 70 further away from the angled upright support 16 which moves the leg 70 toward the back of the angled upright support 16. As the number of upper pages 92 expands as reading takes place, the screw 86 carrying wing nut 88 may be moved closer to the back of the angled upright support 16 forcing the leg 70 further away from the back of the angled upright support 16 so that it may easily hold and bear on a larger number of pages. Pages may conveniently be moved from under the tongue 28 of the base bracket 20 to under the foot 72 of the leg 70 merely by loosening as required, the knob nut 74 on the back of the upper movable support assembly 50.

Figure 7:
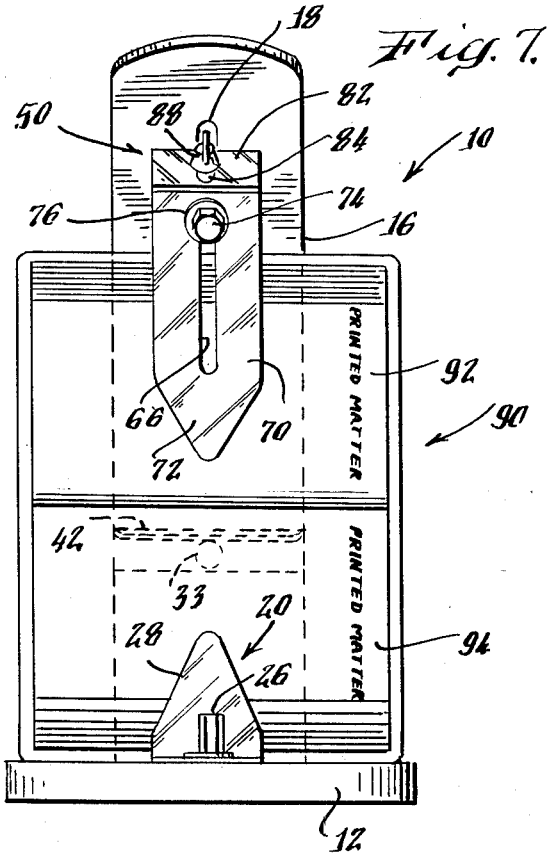
FIG. 7 is a rear view of the bookstand similar to FIG. 3 showing the open book as illustrated in FIG. 6 being positioned therein.

It should also be pointed out that the upper movable support assembly 50 may be moved up and down on the upright support 16 for accommodating the receipt and holding of different size books positioned in an open sideways configuration as illustrated in FIGS. 6 and 7.

Figure 8:
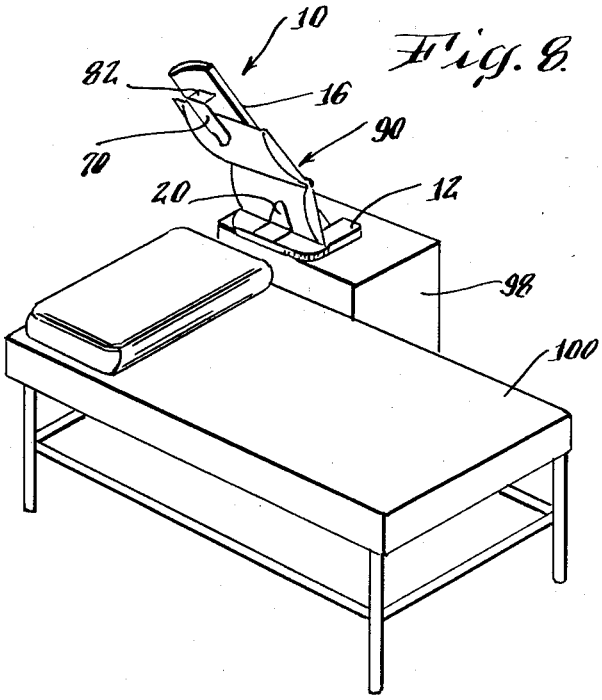
FIG. 8 illustrates the application of the side mounting of an open book as illustrated in FIGS. 6 and 7 in a bedside application for permitting reading while reclining on one side.

When a book is mounted sidewise and open, the mode shown in FIGS. 6 and 7, it may be positioned on a bed stand or night table 98 as shown in FIG. 8, next to a bed 100 where the reader reclines on his side and reads. It should be noted that no fancy shelf structures or swinging supports are required for the reader to read in this position. Furthermore, a small single lamp may be utilized on the table or in connection with the bookstand for lighting the limited area required for reading. The night table 98, of course, may be positioned on the other side of the bed which is normally the case with night tables being positioned on both sides of the bed. Accordingly, the reader may read either on his right or left side depending on which night table he positions the mobile bookstand 10 upon. The reader may conveniently turn the pages of the book as he reads them in their side configuration by simply moving the page from under the tongue 28 of the base bracket 20 and tuck it under the foot 72 of the leg 70. As the number of pages are read and the top pages 92 are increased, the leg 70 may be moved outward simply by loosening the knob nut 74. The flexibility and adjustment of the knob nut 74 along with the slotted plate 72 will allow the holding of a single page by the downwardly extending leg 70 up to the full text of a book which is supported by the right-angled support 42 on the back binding 96.

Figure 9:
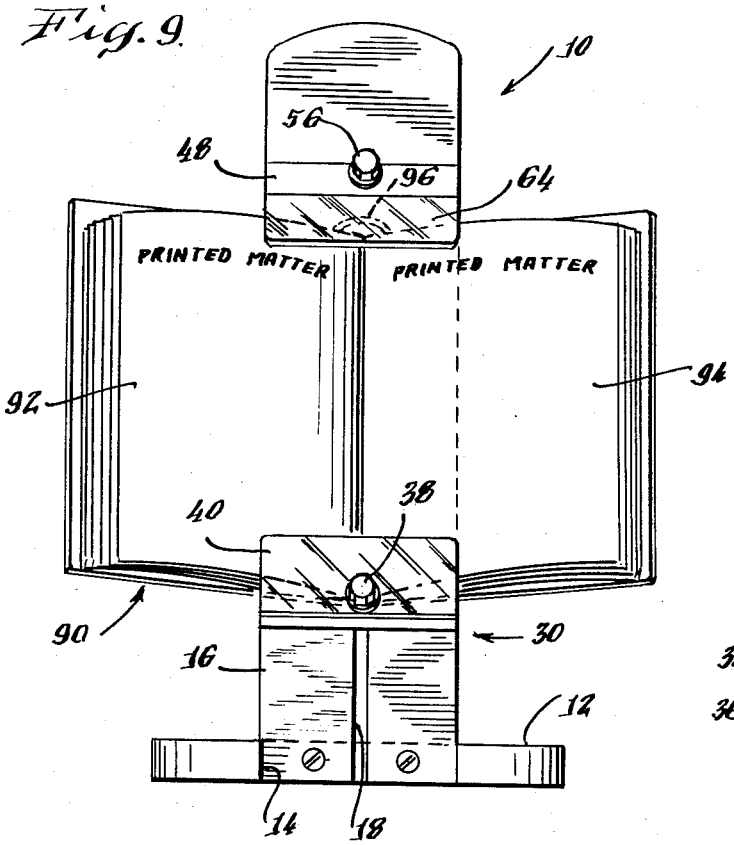
FIG. 9 is a front elevational view of an open book mounted in an upright position on the front of the bookstand.
Figure 10:
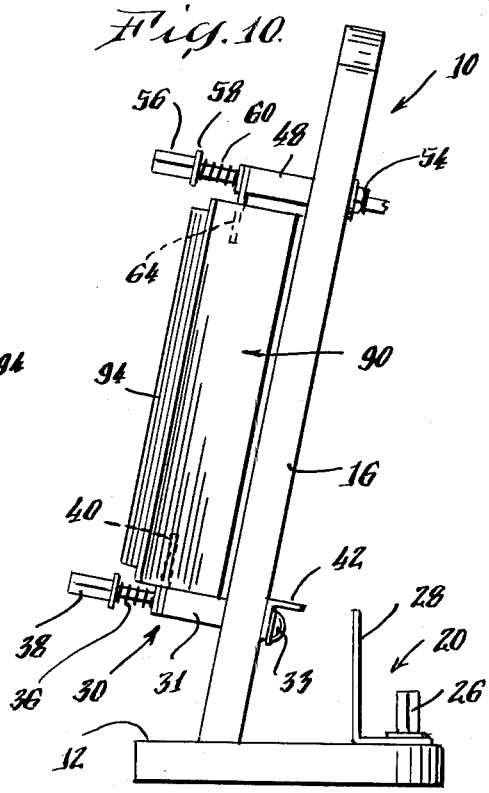
FIG. 10 is a side elevational view of the upright open book mounting illustrated in FIG. 9.
Figure 11:
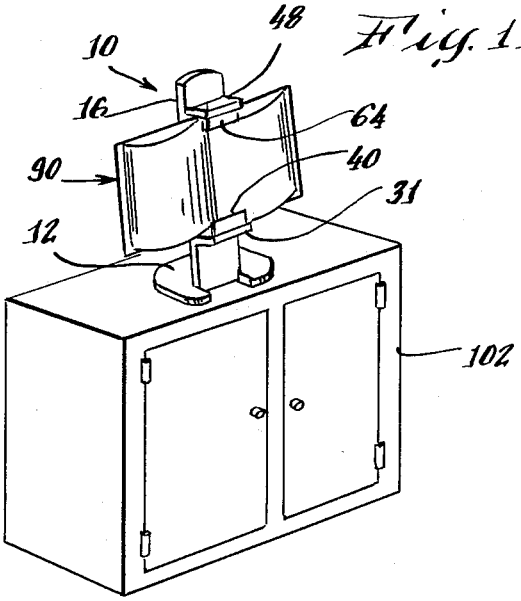
FIG. 11 illustrates one use of the upright open book mounting illustrated in FIGS. 9 and 10 on a cabinet, for example, in a kitchen.

FIGS. 9, 10 and 11 illustrate another mode of mounting a book in the mobile multiple support bookstand 10 in accordance with the present invention. In this mode, an open book 90 is positioned on the shelf 31 of a lower movable support assembly 30. The upper assembly 50 is moved such that the upper shelf 48 of the upper movable support assembly 50 is brought down into contact with the top of the book. The upper movable support assembly is then tightened by screwing down the knob nut 56 to hold it in place and the book 90 is held in an open position by the lower transparent guard rail 40 and the upper transparent guard rail 64 which do not interfere with reading of print in the lower and upper portions of the open book. Mounting the book in the open position on the front of the mobile bookstand provides many uses and holds the book in an open reading position freeing the hands to do other things. Accordingly, a book being held in this position may be positioned, for example, on a kitchen cabinet 102 as illustrated in FIG. 11. Accordingly, the cook can refer to the recipe without holding the book, freeing both hands for the preparation of food.

Accordingly, an extremely mobile, completely adjustable, and multiple use bookstand is provided which is simple to operate. It may be utilized for bed-ridden and hospitalized patients or for anyone who prefers to read in a reclining position or for that matter, may be positioned on a swinging stand or shelf mounted on the bed and utilized when the book is opened in an upright position in accordance with the embodiment illustrated in FIG. 9. Also in the upright open position of the book, the stand is portable and can be used for many uses where the user needs the hands to be free. Auto repair, do-it-yourself repairs and cooking come to mind where both hands are required, and yet instructions are simultaneously needed. Also, in many of these jobs, the hands tend to get dirty which soils the book when the hands are required to hold it open.

The bookholder 10 helps relieve eye strain when reading with bifocal glasses, relieves strain on neck muscles and frees up the arms thereby reducing discomfort and increasing the reading efficiency in a relaxed manner.

This versatile bookstand in accordance with the present invention may be conveniently used in libraries, hospitals, schools, colleges, kitchens, offices, nursing homes, etc., by all types of people either at work or for relaxed reading. The bookstand accommodates reading all types of books both paperback and hard cover as well as magazines, articles, or for that matter, many other types of documents. The bookstand is portable and may be used anywhere e.g. on the beach or on the floor.

The bookstand may be made in various colors and made of different materials to accommodate varied visual appeals.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A multiple position bookstand for holding a book having a back, sides and pages which permits positioning and holding an open book on its side to permit reading the book in a reclining position comprising:

a laterally extending supporting base having an angled upright support with a front and a back mounted thereon and extending upward therefrom in a fixed position, said back of said angled upright support forming an angle of less than 90° with said base, an upstanding base bracket mounted on said base and spaced behind said back of of said angled upright support adapted to bear on the pages of an open book placed on its side behind the back of said angled upright support, said upstanding base bracket being adjustable in a direction toward and away from said upright support a downwardly extending bracket movably mounted on said back of said angled upright support above said upstanding base bracket adapted to hold the pages of an open book placed on its side behind said back of said angled upright support said downwardly extending bracket being adjustable both toward and away from, as well as in a generally vertical direction with respect to said upright support, a first movable support means mounted on said back of said angled upright support between said upstanding base bracket and said downwardly extending bracket and being adjustable in a generally vertical direction with respect to said upright support, said first movable support means having a free extremity which is spaced from the back of said upright support a distance less than the maximum adjusted spacings of said upstanding base and said downwardly extending bracket from said upright support, said free extremity being adapted to contact the back of the book and urge outward an open book positioned on its side between said base bracket and downwardly extending bracket on said back of said angled upright support thereby flattening the open book between said base bracket and said downwardly extending bracket.

2. The multiple position bookstand as claimed in claim 1 having a movable lower support means movably mounted on said front of said angled upright support and having said first movable support means coupled thereto such that said lower support and first movable support means move together on said front and back of said angled upright support, and a movable upper support movably mounted on said front of said angled upright support whereby an opened book may be supported in an open upright position on said front of said angled upright support between said upper and lower movable supports which can be moved to accommodate various sized books as well as providing a height adjustment for the open book on the front of said angled upright support.

3. The multiple position bookstand as claimed in claim 2 in which said downwardly extending bracket is mounted for movement with said movable upper support.

4. The multiple position bookstand as claimed in claim 1 wherein said angled upright support has a central slot therein in which said upper and lower support assemblies are movably mounted.

* * * * *